US005163785A

United States Patent [19]

Zanelli et al.

[11] Patent Number: 5,163,785

[45] Date of Patent: Nov. 17, 1992

[54] METHOD FOR SEALING CONNECTIONS BETWEEN SHEET PILES, AND SHEET PILES EMPLOYING SAID METHOD

[75] Inventors: Harry Zanelli, Villers la Chevre, France; Antoine Weiner, Luxembourg, Luxembourg

[73] Assignees: Unimetal, Metz Cedex, France; Arbed, Luxembourg, Luxembourg

[21] Appl. No.: 712,877

[22] Filed: Jun. 11, 1991

[30] Foreign Application Priority Data

Jun. 13, 1990 [FR] France ..... 90 07475

[51] Int. Cl.[5] ..... E02D 5/00

[52] U.S. Cl. ..... 405/277; 405/279; 405/284; 405/274

[58] Field of Search ..... 405/273, 274, 276, 277, 405/278, 279, 284

[56] References Cited

U.S. PATENT DOCUMENTS

| | | | |
|---|---|---|---|
| 1,943,933 | 1/1934 | Smith | 405/274 X |
| 3,822,557 | 7/1974 | Frederick | 405/278 X |
| 4,808,039 | 2/1989 | Fischer | 405/274 X |
| 4,863,315 | 9/1989 | Wickberg | 405/274 X |
| 4,981,540 | 1/1991 | Prochhorst | 405/278 X |

FOREIGN PATENT DOCUMENTS

| | | |
|---|---|---|
| 1001453 | 10/1989 | Belgium . |
| 0255683 | 6/1988 | European Pat. Off. . |
| 2553744 | 6/1977 | Fed. Rep. of Germany . |
| 1347816 | 11/1963 | France . |
| 1387422 | 12/1964 | France . |
| 8302240 | 1/1985 | Netherlands . |

*Primary Examiner*—Randolph A. Reese
*Assistant Examiner*—J. Russell McBee
*Attorney, Agent, or Firm*—Cushman, Darby & Cushman

[57] ABSTRACT

A method for sealing the connection between two sheet piles, this connection being achieved by using claws integrated with the sheet piles. Prior to the interlocking of the sheet piles, a jointing band of an elastic, compressible and/or hydroswellable organic material is stuck to the claw of at least one of the sheet piles. The method further includes fixing a metal sheet to the free surface of the band, and then interlocking the sheet piles. The invention also provides a sheet pile comprising a claw provided with a band of an elastic, compressible and/or hydroswellable organic material, characterized in that the outer surface of the band is at least partly covered with a metal sheet which is connected to the band.

9 Claims, 1 Drawing Sheet

METHOD FOR SEALING CONNECTIONS BETWEEN SHEET PILES, AND SHEET PILES EMPLOYING SAID METHOD

BACKGROUND OF THE INVENTION

1. Field of the Invention

The present invention relates to he field of assembly of metal sheet piles, in particular of steel, for forming, for example, walls which must provide a good tightness with respect to liquids, such as water.

2. Description of the Prior Art

It is known that the edge portions of the sheet piles are so shaped as to permit the hooking of one sheet pile to another in a connection which may provide a more or less large degree of flexibility. Different types of shape for the edge portions of sheet piles exist, these edge portions being termed "claws". Some types of claws, in particular those of the sheet piles termed "Larssen" sheet piles, have a planar bearing surface and, upon the assembly (termed "interlocking") of two sheet piles, achieved by sliding one claw in the other, the planar bearing surfaces of their respective claws come to face each other. Other types of claws have only curved surfaces.

It may be desired to render the connections between two sheet piles tight or sealed, in particular in the case where they are intended to be part of a wall partly immersed in an aquatic medium, for example in a harbor construction. Several sealing methods are essentially employed. First, the sheet piles may be welded after their assembly. This method takes a long time to carry out and the weld must be made before the immersion of the assembly. Further, the connection sealed in this way remains perfectly rigid, whereas a certain flexibility may be desired. A second method consists in, after the interlocking of the sheet piles, injecting into the space left free between the claws a material, for example based on polyurethane, which is in the liquid state and subsequently hardens and forms an elastic sealing element (see the German patent No. 2722978). This method presupposes that, at the moment of the injection, the sheet piles have already taken up their final positions and that one of the ends of their connection remains accessible. A third method consists in depositing on the claw of one of the sheet piles of the assembly a layer of an organic material which has a certain elasticity, such as a polyurethane or a rubber, and which may also have the feature of swelling in the presence of water. Such a material is described for example in the European patent No. 50906. The connection is correctly sealed and it retains a certain flexibility. However, the layer of organic material is often torn away or damaged when interlocking the sheet piles, by the effect of intense frictions which occur between the layer and the claw of the other sheet pile. The elastic organic material is consequently no longer able to perform its function in an effective manner.

SUMMARY OF THE INVENTION

An object of the invention is to render this last-mentioned method for sealing connections between sheet piles more reliable.

The invention therefore provides a method for sealing a connection between two sheet piles, this connection being achieved by means of claws integrated with the sheet piles, comprising, prior to the interlocking of the sheet piles, sticking on the claw of at least one of the sheet piles a jointing band of an elastic, compressible and/or hydroswellable organic material, characterized in that the method further comprises fixing a metal sheet on the free surface of the band, and then interlocking the sheet piles.

The invention also provides a sheet pile comprising on at least one of its edges a claw for its connection with another sheet pile, at least one of the claws being provided in at least a part of its length with a band of an elastic and/or hydroswellable organic material, characterized in that the outer surface of the band is at least partly covered with a metal sheet connected to said band.

The metal sheet is preferably of steel having a thickness of about 200 μm.

As will have been understood, the invention comprises covering the outer surface of the jointing band serving to seal the connection between two sheet piles with a metal sheet which avoids the deterioration of said band by favoring the sliding of the claws one inside the other when interlocking the sheet piles.

BRIEF DESCRIPTION OF THE DRAWINGS

A better understanding of the invention will be had from the following description, with reference to the single accompanying sheet of drawings, in which.

DETAILED DESCRIPTION OF THE PRESENTLY PREFERRED EXEMPLARY EMBODIMENT

Figure 1:
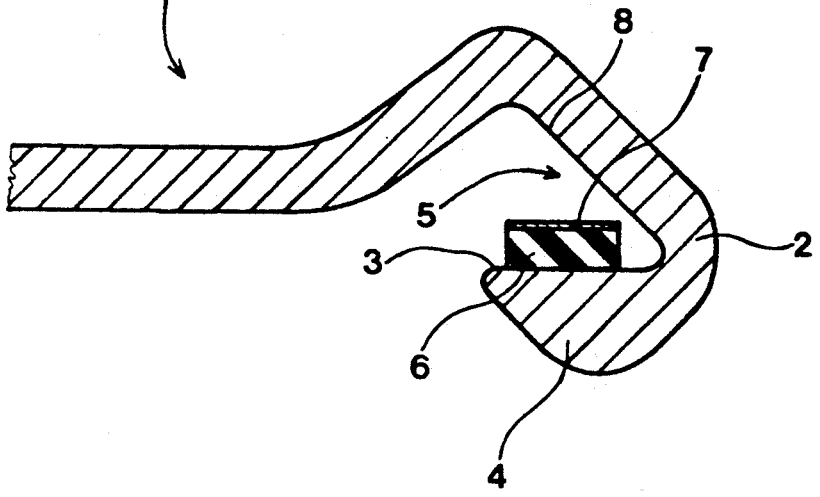
FIG. 1 is an partial perspective and sectional view of an edge portion of a "Larssen" sheet pile provided with an elastic band whose upper face is covered with a metal sheet according to the invention.
Figure 2:
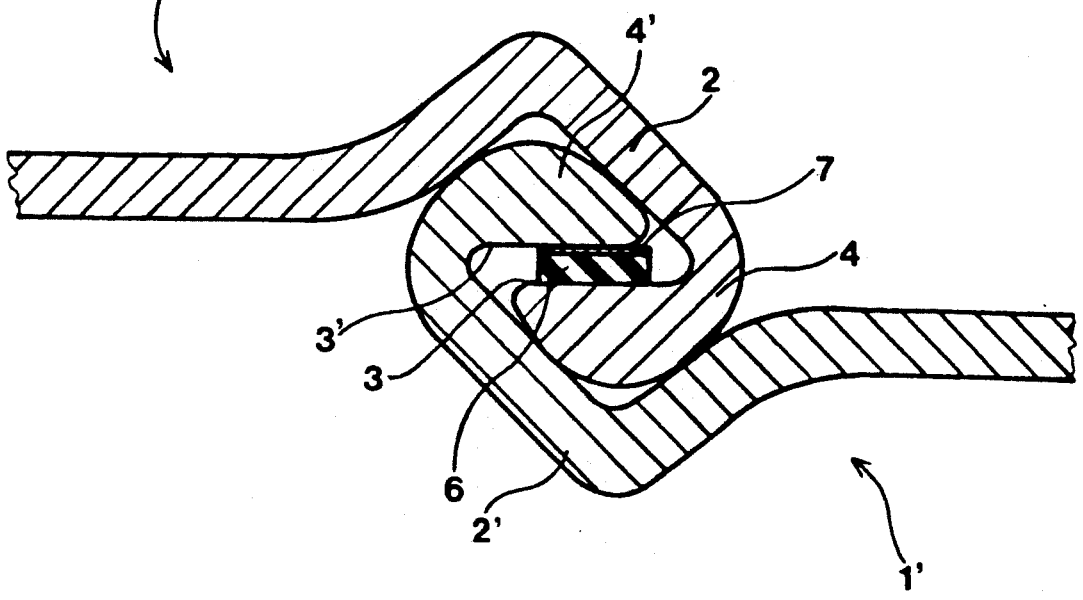
FIG. 2 is a similar view of the edge portions of two interlocked sheet piles the connection of which is sealed by means of the aforementioned elastic band and sheet.

FIG. 1 shows an edge portion of a sheet pile 1 of the type termed "Larssen" sheet pile. Such a sheet pile 1 comprises on each of its edges a claw 2 for its connection with the following sheet pile 1' in the construction of which they are a part, as shown in FIG. 2. This claw 2 has an identical configuration on each edge of each sheet pile and defines a planar bearing surface 3 provided on a solid portion 4. When two sheet piles are interlocked, their planar bearing surfaces come to face each other, whereas the solid portion 4' of the claw 2' of the second sheet pile comes to fill the inner space 5, defined by the claw 2 of the first sheet pile, with a certain clearance. It is this clearance which must be filled by the method according to the invention in such manner as to seal the connection between the sheet pile 1 and the neighbouring sheet pile 1'.

Conventionally, the sheet pile 1 comprises, on the planar bearing surface 3 of its claw 2, a band 6 made from an elastic material, such as rubber. This band 6 extends along the claw 2 to the extent of the connection to be sealed. Its width varies with the type of sheet pile and is of the order of 15 to 20 mm. According to the invention, the band 6 is covered on its outer surface facing toward the space 5 with a metal sheet or ribbon 7 which is, for example, of steel having a thickness of 200 μm. The overall thickness of the band-sheet unit must be such that it leaves between the sheet 7 and the confronting inner surface 8 of the claw 2 a space which is insufficient to allow the positioning of the solid portion 4' of the claw 2' of the sheet pile 1' in this space without exerting a compressive force on the elastic band 6, as shown in FIG. 2. This overall thickness of course depends on the dimensions of the claws employed and is usually of the order of 5 to 8 mm. In the course of the interlocking of the sheet piles 1 and 1', the planar bearing surface 3' exerts a pressure on the sheet 7 and the band 6 and the latter yields owing to its elasticity and thereby permits the progression of the claw 2' into the claw 2. The presence of the sheet 7 results in a steel-on-steel sliding. This sliding occurs with much less friction than if the elastic band 6 were bare and the risks of deterioration of the band 6 when interlocking the sheet piles are considerably reduced. Optionally, the sheet may be lubricated so as to still further decrease the friction.

As a variant, it is possible to employ for the band of organic material a material termed "hydroswellable", i.e. a material which has the property of increasing in volume in contact with a liquid. These materials, such as aminoplastic resins or some rubbers, are often employed for this purpose at the present time, and the addition of a metal sheet to such an organic band has the same beneficial results as its addition to a simple elastic band such as that described hereinbefore. In the case of the use of a hydroswellable band, it is not necessary that, in the dry state, the space between the metal sheet and the confronting inner surface of the claw be reduced to the point of imposing a compression of the band when interlocking the sheet piles. Such a compression of the band by the claw of the second sheet pile is only necessary when the band has swollen owing to the absorption of the surrounding humidity. This solution has the advantage over that of the purely elastic band of leaving more space inside the claw of the first sheet pile and thereby facilitating the interlocking between the latter and the second sheet pile.

The metal sheet or ribbon preferably has the same width as the organic band, as shown in FIGS. 1 and 2. However, a sheet width which is less than that of the band may be used, but with the risk of creating, upon the interlocking of the sheet piles, a steel-organic material friction in the parts of the band which are not covered with the sheet and resulting in sliding conditions which are less favorable than in the preceding case.

Optionally, the claws of both sheet piles may be provided with an organic band covered with a metal sheet according to the invention. It will be understood that the thickness of the bands must be so calculated that the space between the claws of the two sheet piles remains sufficient to allow their interlocking.

The described method allows interlocking great lengths of sheet piles (several metres) without deteriorating the sealing elements. It is applicable to all types of steel pile claws, both those having, as the "Larssen" sheet piles, a planar portion and those having only curved surfaces. Indeed, the metal sheets or ribbons are thin enough to correspond in shape to the outer surface of the organic band irrespective of the shape of the latter. It is also applicable to connecting elements provided with claws for interconnecting two sheet piles and imposing on the latter special respective orientations.

What is claimed is:

1. A method for sealing a connection between sheet piles which include claws integrated therewith, said connection being achieved by an interlocking or said claws, said method comprising the steps of:

providing sheet piles to be connected, each of said sheet piles have a claw, fixing to the claw of at least one of said sheet piles a band of elastic organic material, fixing a metal sheet on an outer surface of said band, and interlocking said sheet piles by connecting the claws of the sheet piles.

2. A method according to claim 1, wherein step of fixing a band of elastic organic material includes providing a band formed of a compressible organic material.

3. A method according to claim 1, wherein step of fixing a band of elastic organic material includes providing a band formed of a hydroswellable organic material.

4. A method according to claim 1, wherein step of fixing a band of elastic organic material includes providing a band formed of a compressible and hydroswellable organic material.

5. A sheet pile comprising:

two opposed edges with a claw formed on at least one of said edges, said claw provided for connection of said sheet pile with another sheet pile, a band of an elastic organic material provided on said claw, said band having an outer surface, and a metal sheet which at least partly covers said outer surface and is connected to said band.

6. A sheet pile according to claim 5, wherein said organic material is compressible.

7. A sheet pile according to claim 5, wherein said organic material is hydroswellable.

8. A sheet pile according to claim 5, wherein said organic material is compressible and hydroswellable.

9. A sheet pile according to claim 5, wherein said metal sheet is of steel having a thickness of about 200 μm.

* * * * *